United States Patent [19]

Gruzling

[11] Patent Number: 4,789,302

[45] Date of Patent: Dec. 6, 1988

[54] PROPELLER SHROUD

[76] Inventor: Josip Gruzling, 1065 Heritage Blvd., North Vancouver, B.C., Canada, V7J 3G7

[21] Appl. No.: 12,053

[22] Filed: Feb. 6, 1987

[51] Int. Cl.[4] ..... B63H 5/14

[52] U.S. Cl. ..... 415/213 C; 416/189; 440/67

[58] Field of Search ..... 416/189 R, 189 B; 440/67, 71; 415/213 C

[56] References Cited

U.S. PATENT DOCUMENTS

| | | | |
|---|---|---|---|
| 2,030,375 | 2/1936 | Kort | 440/67 |
| 2,139,594 | 12/1938 | Kort | 440/67 X |
| 3,056,374 | 10/1962 | Linhardt | 415/213 C X |
| 3,986,787 | 10/1976 | Mouton et al. | 415/7 |
| 4,166,596 | 9/1979 | Mouton et al. | 415/7 X |
| 4,219,303 | 8/1980 | Mouton et al. | 416/85 X |
| 4,509,925 | 4/1985 | Wührer | 446/67 |

FOREIGN PATENT DOCUMENTS

| | | | |
|---|---|---|---|
| 634472 | 8/1936 | Fed. Rep. of Germany | 440/67 |
| 660419 | 5/1938 | Fed. Rep. of Germany | 440/67 |
| 2916287 | 10/1980 | Fed. Rep. of Germany | 440/67 |
| 498391 | 1/1920 | France | 416/189 R |
| 846423 | 9/1939 | France | 415/213 C |
| 2507999 | 12/1982 | France | 440/67 |
| 994 | 1/1982 | Japan | 440/67 |
| 121192 | 6/1985 | Japan | 440/67 |
| 486956 | 12/1975 | U.S.S.R. | 415/213 C |
| 1104055 | 7/1984 | U.S.S.R. | 416/189 B |
| 493414 | 10/1938 | United Kingdom | 440/67 |
| 596802 | 1/1948 | United Kingdom | 416/189 B |
| 677849 | 8/1952 | United Kingdom | 416/189 B |
| 1324356 | 7/1973 | United Kingdom | 416/189 B |

*Primary Examiner*—Everette A. Powell, Jr.
*Attorney, Agent, or Firm*—Richard C. Litman

[57] ABSTRACT

A propeller shroud or nozzle, made with airfoil section of high lift to drag ratio, increases thrust, speed and efficiency of a fixed or controllable pitch propeller operating inside the shroud. Shroud section is designed with continuously curved inside and outside surface to create maximum lift and minimum drag. For the larger propellers used on ships, and for lower cost of construction, shroud is fabricated using plates of steel and stainless steel or other suitable material, built as a number of straight airfoil segments forming a polygon approximating circular ring. Low shroud drag makes possible improving thrust and speed of vessels, even when operating at high speed, compared to optimally designed propeller without the shroud.

3 Claims, 1 Drawing Sheet

PROPELLER SHROUD

BACKGROUND OF INVENTION

Shrouded or a nozzle propellers have been used on tugs, river pushboats and other low speed ships, for increase of the propeller thrust, for over fifty years. According to accepted nozzle theory, nozzles are classified as accelerating and decelerating. Existing accelerating type nozzles are used for increase of thrust at low speeds, while high drag makes them unsuitable for the higher speeds. Decelerating type nozzle are used for lowering propeller cavitation and noise, important for the military applications, at the cost of lower efficiency. This invention relates to the accelerating type nozzles. Higher lift generated by the shroud section generates greater thrust, and low section drag makes this thrust available at the higher operating speeds, previously believed impossible.

SUMMARY OF THE INVENTION

The object of this invention is to improve efficiency of the propeller operating in all types and sizes of vessels, at all operating speeds. This was achieved by adapting the theory of the wing section to the nozzle section design, optimized for the turbulent flow, having a higher lift coefficient, with a much lower drag coefficient then the nozzles presently in use. For example, the industry standard nozzle 19*a* has a drag coefficient of 0.17, while this nozzle design has drag coefficient ranging from 0.008 to 0.012.

This invention also relates to the manufacturing method of the nozzle construction, required to achieve this low drag and high lift coefficient. Nozzles are fabricated as linear airfoil sections connected to form polygon, approximating circular shroud. Smaller nozzles can be made by other methods like casting and machining to the required shape.

This invention enables higher propulsive efficiency for the vessels operating at higher speeds, where prior to this invention, this was not possible.

DETAILED DESCRIPTION

Two benefits are obtained by utilization of the present invention which are interrelated, namely, an increase in the propulsive efficiency of the vessel, increasing the speed of the vessel using same power or maintaining the same speed with less power and lower fuel consumption and improved structural integrity of the propeller shroud over any propeller shroud used to date. Increase in the efficiency is achieved with the use of highly efficient airfoil section designed for minimum drag and maximum lift. The high efficiency of the propeller shroud is accomplished by constructing the propeller shroud with laterally flat segments that become circular only when a large number are joined together avoiding a compound curvature and making fabrication of the highly efficient propeller shroud possible.

Figure 1:
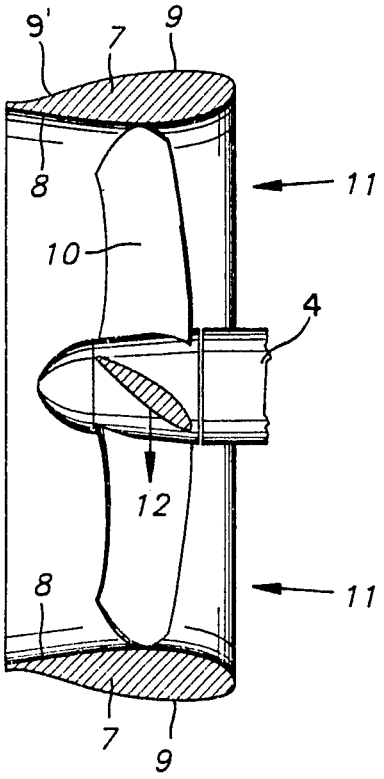
FIG. 1 is a typical section through the center of the nozzle showing the location of the propeller.

The propeller shroud in this invention is shown in FIG. 1 having a unique airfoil section 7 that is continuously curved longitudinally on both the inside surface 8 and the outside surface 9 and provides a coefficient of drag of less than 0.013 and a section camber in the range of 0 to 0.025 of the chord length. A concave area of the camber is disposed on the outside 9 of the shroud section and the resultant maximum camber is located from 0.25 to 0.35 of the chord length from the leading edge, with a section thickness in a range from 0.05 to 0.24 of the chord length and a maximum thickness located at 0.25 to 0.35 of the chord length from the leading edge. The shroud has a section cord length of 0.3 to 0.6 of the propeller diameter and the angle between the section chord and propeller shaft 4 is between −6 to +6 degrees, with a typical section being NASA section LS(1)-0421 Mod and section LS(1)-0417 Mod. The propeller blade 10 is located near the narrowest internal diameter of the shroud with the propeller blade tips shaped to conform to the inside surface of the shroud to maintain minimum blade tip-to-shroud clearance. When operating in the ahead condition, arrow 11 shows the direction of fluid entering nozzle while arrow 12 shows the direction of the propeller rotation while operating in the ahead condition.

Figure 2:
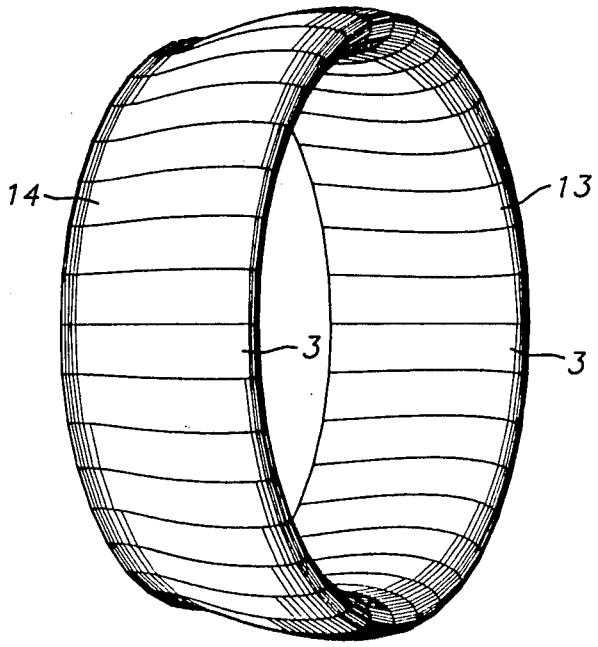
FIG. 2 is a isometric view of the polygon shaped nozzle.

FIG. 2 shows a propeller shroud constructed of a large number of laterally flat and longitudinally curved segments 3 joined together.

Figure 3:
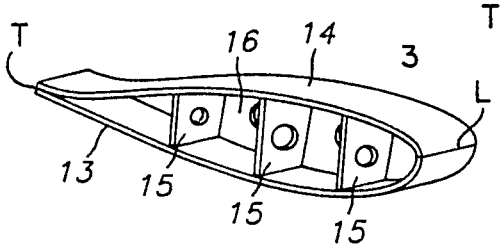
FIG. 3 is a isometric view of the single section of the polygon shaped nozzle shown in FIG. 2.
Figure 4:
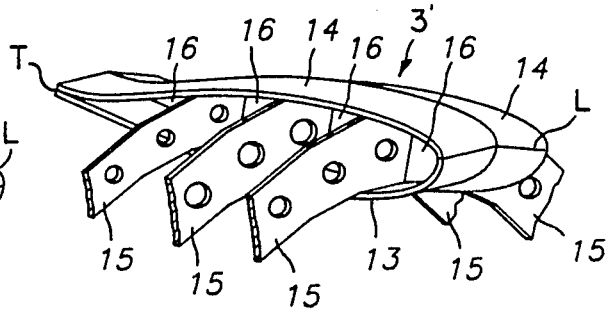
FIG. 4 is a isometric view of the alternate method of construction of a nozzle shown in FIG. 2.

Two representative shroud segment constructions according to the present invention are shown in the drawings, one being shown in FIG. 3 and the second in FIG. 4. Shroud segment 3 of FIG. 3 shows an inside shell or surface 13, together with an outside shell or surface 14, joined by one or more transverse segmented ring frame members and a longitudinal frame 16 spanning the cavity C between the two surfaces. Each segment 3 is assembled individually by welding each inside shell 13 and outside shell 14 to the longitudinal frame 16 on the inside of the segment. Transverse frames 15 are welded to the inside shell 13, outside shell 14, and to the longitudinal frame 16 using continuous welds on both sides of the transverse frame. Inside shell 13 and outside shell 14 are joined at their leading edges L using butt welds. Trailing edge T of the outside shell 14 is scalloped and welded to the inside shell 13 adjacent the trailing edge T. Individual shroud segment inside and outside surfaces 13 and 14 are welded to the adjoining longitudinal frame 16 and to each other by using deep penetration V welds.

FIG. 4 shows an alternate method of construction of a segment 3' forming the shroud of FIG. 2 using one or more continuous transverse polygonal ring frame members 15' and a segmented longitudinal frame 16. Assembly of the propeller shroud is started by welding first, the inside shell or surface 13 and outside shell or surface 14 to the ring frames 15' continuously on both sides. Longitudinal segmented frame 16 is inserted on one side of the shell plates and welded from the inside to the shell surfaces and to the ring frames. Inside shell 13 and outside shell 14 are joined to the leading edges L using butt welds while the trailing edge T of the outside shell 14 is scalloped and welded to the inside shell 13. Another segmented longitudinal frame 16 is inserted on the opposite side of the shell surfaces. Another pair of the shell surfaces 13 and 14 are installed and welded to this latter longitudinal frame and to each other with deep penetrating V welds. This process is repeated until the shroud is completed.

All existing propeller shrouds only improve propeller performance at lower speeds and are used successfully only on tugboats and other vessels requiring increase in thrust at low speeds, while this invention improves propeller thrust at low speeds as well as increasing propeller efficiency at higher speed, making this invention suitable for all types of vessels.

Existing shroud designs have exterior shell only used as a closing cover and is attached to the shroud strucure with plug or slot welds and is not an integral part of the shroud and does not contribute to the structural strength of the shroud, while this invention integrates interior and exterior shell and framing into single structure.

FIG. 4. shows alternate construction method of the nozzle of FIG. 2. One or more ring frames 15 are continuous while longitudinal frames are made up as segments. Shell plates are welded together and to the longitudinal frame. Shell plates are welded to the longitudinal and ring frames, and are joined together at the leading and trailing edge before next longitudinal frame is inserted.

For the steel ships nozzles, inside shell plates are preferably made of stainless steel, to avoid erosion due to cavitation near the propeller blade tips.

Figure 5:
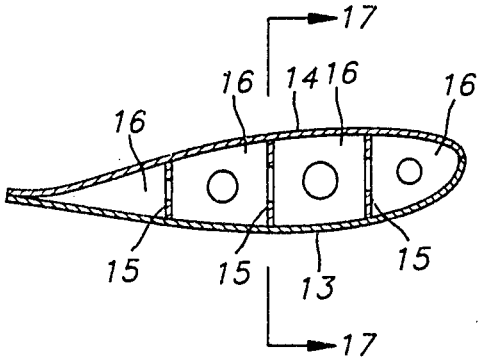
FIG. 5 is a section through the nozzle taken at 18—18 of FIG. 6.
Figure 6:
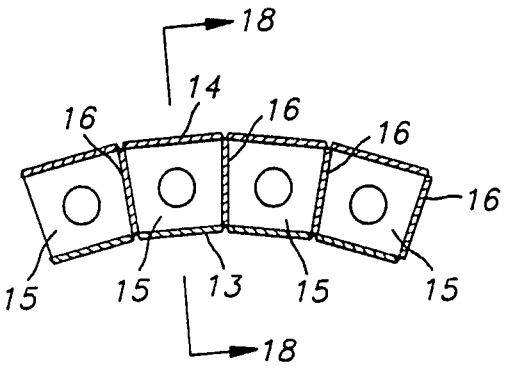
FIG. 6 is a section through the nozzle taken at 17—17 of FIG. 5.

FIG. 5 is a longitudinal section through the center of the segment shown in FIG. 3 and along 18—18. FIG. 6 is a section along 17—17.

I claim:

1. In a marine propulsion apparatus including a shaft having a propeller thereon and a shroud surrounding said propeller, the improvement comprising:

said shroud including a plurality of adjacent segments abutting one another, each said segment comprising an outside surface and an inside surface each having a leading and trailing edge. said outside and inside surfaces substantially laterally flat, said inside and outside surface leading and trailing edges respectively connected together to provide an airfoil section with said inside and outside surfaces continuously curved from said connected leading and trailing edges, said inside and outside surfaces spaced apart between said leading and trailing edges to define a cavity therebetween, each said segment airfoil section having a camber in the range of 0 to 0.025 of the the chord length thereof, said outside surface including a concave area thereon, said section thickness ranging from 0.05 to 0.24 of the chord length and having a maximum thickness located 0.25 to 0.35 of the chord length from said leading edges, each said segment airfoil section having a maximum camber located from 0.25 to 0.35 of the chord length from said connected leading edges, said segment airfoil section having a chord length between 0.3 and 0.6 of the diameter of the propeller surrounded by said shroud, said segment airfoil sections disposed such that the angle between the chord thereof and the propeller shaft ranges between −6 to +6 degrees, at least one ring frame member disposed transversely within said cavities of said segments, said ring frame member connected respectively to said segment inside and outside surfaces and laterally connecting together said plurality of segments to provide said shroud, and a longitudinal frame member connected to each said connected inside and outside surfaces and said ring frame member of each said segment.

2. A marine propulsion apparatus according to claim 1 wherein, said ring frame member comprises a separate element disposed within said cavity of each said segment.

3. A marine propulsion apparatus according to claim 1 wherein, said ring frame member comprises a polygonal element having a plurality of sides equal to the total number of said plurality of segments forming said shroud.

* * * * *